US006815882B2

(12) United States Patent
Murakami et al.

(10) Patent No.: US 6,815,882 B2
(45) Date of Patent: Nov. 9, 2004

(54) GLASS BULB FOR A COLOR CATHODE RAY TUBE, AND COLOR CATHODE RAY TUBE

(75) Inventors: Toshihide Murakami, Chiba (JP); Tsunehiko Sugawara, Chiba (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 10/158,055

(22) Filed: May 31, 2002

(65) Prior Publication Data

US 2003/0030365 A1 Feb. 13, 2003

(30) Foreign Application Priority Data

May 31, 2001 (JP) ..... 2001-164084

(51) Int. Cl.[7] ..... H01J 31/00
(52) U.S. Cl. ..... 313/477 R
(58) Field of Search ..... 313/477 R; 220/2.1 A, 220/2.1 R, 2.3 A

(56) References Cited

U.S. PATENT DOCUMENTS

| | | | | |
|---|---|---|---|---|
| 5,238,132 A | | 8/1993 | Shibaoka et al. | |
| 5,445,285 A | | 8/1995 | Sugawara et al. | |
| 5,536,995 A | | 7/1996 | Sugawara et al. | |
| 5,568,011 A | * | 10/1996 | Ragland et al. | 313/477 R |
| 5,837,026 A | | 11/1998 | Sugawara et al. | |
| 5,925,977 A | * | 7/1999 | Sugawara et al. | 313/477 R |
| 5,964,364 A | | 10/1999 | Shimizu et al. | |
| RE36,838 E | | 8/2000 | Sugawara et al. | |
| 6,121,723 A | | 9/2000 | Sugawara et al. | |
| 6,236,151 B1 | | 5/2001 | Murakami et al. | |

FOREIGN PATENT DOCUMENTS

| | | |
|---|---|---|
| EP | 1 142 840 | 10/2001 |
| EP | 1 241 700 | 9/2002 |
| EP | 2 376 463 | 12/2002 |

* cited by examiner

*Primary Examiner*—Nimeshkumar D. Patel
*Assistant Examiner*—Peter Macchiarolo
(74) *Attorney, Agent, or Firm*—Oblon, Spivak, McClelland, Maier & Neustadt, P.C.

(57) ABSTRACT

A glass bulb for a color cathode ray tube, which comprises a panel, a funnel connected to the panel and a neck, the panel comprising a face portion and a skirt portion constituting a side wall of the face portion and having a seal edge portion at the end portion, wherein such a compressive stress $\sigma_c$ that 50 MPa$\leqq|\sigma_c|\leqq$250 MPa is produced by an ion-exchange method to at least one of short axis end portions and long axis end portions on the outer surface of the face portion; the average thickness $t=(t_c+t_{max})/2$ of the face portion represented by the central thickness $t_c$ of the face portion and the maximum thickness $t_{max}$ of the face portion, and the thickness $t_{se}$ at the seal edge portion, satisfy the relation $t/t_{se}\leqq 1.4$; and the maximum value $\sigma_{VTmax}$ of the tensile stress generated at the face portion when vacuumized is 20 MPa$\leqq\sigma_{VTmax}$<200 MPa.

5 Claims, 3 Drawing Sheets

GLASS BULB FOR A COLOR CATHODE RAY TUBE, AND COLOR CATHODE RAY TUBE

BACKGROUND OF THE INVENTION

1. Field of the Invention

The present invention relates to a color cathode ray tube to be used for e.g. a display for a television broadcast receiver (hereinafter referred to as a television) or a computer, and a glass bulb to be used for such a cathode ray tube.

2. Discussion of the Background

Firstly, the construction of a color cathode ray tube will be described referring to the attached drawings. FIG. 1 is a partially cross-sectional view of the entirety of the color cathode ray tube. FIG. 2 is an enlarged view of FIG. 1 at a portion S including the sealing portion and its vicinity. Here, in the present invention, a cathode ray tube is meant for a color cathode ray tube unless otherwise specified.

The envelope of the cathode ray tube 1 is constituted by a glass bulb 2 which basically comprises a panel 3 for displaying picture images, a funnel-shaped funnel 4 sealingly bonded to the panel 3 and a neck 5 accommodating an electron gun 17. The panel 3 is constituted by an approximately rectangular face portion 7 constituting a picture image-displaying screen and a skirt portion 6 extending in a direction substantially perpendicular to the face portion 7 from its periphery via a blend R portion 9.

An explosion proof reinforcing band 8 is wound around the circumference of the skirt portion 6 to maintain the panel strength and to prevent scattering upon breakage. On the inner surface side of the face portion 7, a phosphor screen 12 which emits fluorescence by electron beam bombardment from an electron gun 17 and an aluminum film 13 to reflect the fluorescence emitted from the phosphor screen 12 towards the rear side of the cathode ray tube (towards the funnel 4 side), to the front side (to the face 7 side), are laminated, and a shadow mask 14 which regulates the position for electron beam bombardment, is further provided. The shadow mask 14 is fixed to the inner surface of the skirt portion 6 by stud pins 15. Further, A in FIG. 1 indicates a tube axis connecting the center axis of the neck 5 and the center axis of the panel 3.

Such a panel 3 is sealingly bonded to a seal edge portion 16' of the funnel 4 by a sealing material such as a solder glass provided at the seal edge portion 16 corresponding to the end portion of the skirt portion 6, whereby a sealing portion 10 is formed.

The glass bulb 2 for a cathode ray tube having the above construction, is used as a vacuum vessel, whereby atmospheric pressure is exerted to the outer surface. The glass bulb is in unstable deformed state due to an asymmetrical shape as is different from a spherical shell, and a stress is exerted over a relatively wide range (a stress formed when the glass bulb is vacuumized, will hereinafter be referred to as a vacuum stress). In such a state that a high tensile vacuum stress is applied to the outer surface, a delayed fracture may take place due to the effect by moisture in the atmosphere, which may cause decrease in safety and reliability.

The face portion 7 as a portion which displays picture images has the highest flatness in the cathode ray tube and thereby has a low rigidity, and it is most significantly deformed when the inside of the cathode ray tube is depressurized and an atmospheric pressure is applied thereto. Further, the face portion 7 is supported by the blend R portion 9 having a high rigidity, whereby a high tensile vacuum stress is likely to generate in the vicinity of the blend R portion 9 along with the deformation of the face portion 7. Further, the deformation of the face portion 7 functions as a force to deform the skirt portion 6 towards the outside via the blend R portion 9, and accordingly a high tensile vacuum stress is generated also at the sealing portion 10.

However, the sealing portion sealingly bonded by means of a sealing material has the lowest allowance against the tensile vacuum stress in the glass bulb, and the allowable stress at the sealing portion becomes lower when the accuracy of the flatness at the sealing surface between the panel and the funnel is low.

A television employing a cathode ray tube has a demerit of being heavy as compared with a plasma display and a liquid crystal display, whereby weight reduction of a glass bulb has been desired. Further, in recent years, a cathode ray tube having a face portion having a higher flatness has been desired to decrease distortion of picture images as far as possible to improve visibility. However, by making the face portion flat, asymmetry of the glass bulb shape increases, and the glass bulb is in a further unstable deformed state, whereby tensile vacuum stress generated to the respective portions tends to increase. In addition, the amount of glass used tends to decrease as compared with conventional ones due to weight reduction, whereby a higher deformation energy tends to be accumulated on the glass bulb, thus increasing possibility of destruction.

Accordingly, if the panel thickness is made thin and the face portion is made flat at the same time to accomplish such weight reduction, a tensile vacuum stress generated at the face portion will significantly increase as described above. To overcome the above problem, tempering methods to produce a compressive stress to the panel surface have been developed.

Heretofore, as a means to reduce the weight of the glass bulb for a cathode ray tube, it has been practically proposed to form a compressive stress layer on the surface of a panel in a thickness of about ⅙ of the glass by means of e.g. a physical tempering method, as disclosed in Japanese Patent No. 2904067. However, it is impossible to uniformly quench a panel or funnel having a three dimensional structure and a non-uniform thickness distribution. Consequently, due to the non-uniform temperature distribution, a large tensile residual stress will be formed together with the compressive stress, whereby the compressive stress is rather limited to a level of 30 MPa at best, and it has been impossible to produce a large compressive stress. Namely, when a physical tempering method is employed, the weight reduction of the glass bulb is limited, since the compressive stress which can be produced, is relatively small.

On the other hand, it is known to reduce the weight by tempering the surface of a glass bulb by an ion-exchange method. This method is a method wherein certain alkali ions in glass are substituted by ions larger than the alkali ions at a temperature of not higher than the distortion point, and a compressive stress layer is formed on the surface by the volume increase. For example, it can be accomplished by immersing a strontium/barium/alkali/alumina/silicate glass containing from about 5 to about 8% of $Na_2O$ and from about 5 to about 9% of $K_2O$, in a molten liquid of $KNO_3$ at about 450° C. In the case of such ion-exchange method, a large compressive stress at a level of from 50 to 300 MPa can be obtained, and it is advantageous for the weight reduction over the physical tempering in that no necessary tensile stress will be formed.

The ion-exchange method is usually carried out in the process of panel production, i.e. it is carried out after press molding and polishing, whereby a high compressive stress can be produced to the face portion and the skirt portion. However, the sealing portion is provided in such a manner that after e.g. shadow mask is attached to the inside of the panel, the seal edge portion of the panel and the seal edge portion of the funnel are put together and welded by means of a sealing material such as a solder glass, whereby no compressive stress can be produced by means of an ion-exchange method, and accordingly the difference in strength between the face portion and the seal portion tends to further widen.

On the other hand, the face portion to which a high compressive stress is produced by an ion-exchange method, can tolerate a high tensile vacuum stress as compared with a conventional one, and consequently, the face portion can significantly be made thin, which contributes to weight reduction. However, if the face portion is made thin as far as possible based on the compressive stress value produced by the ion-exchange method, the distortion amount of the face portion tends to increase, whereby the tensile vacuum stress to be generated at the sealing portion may further increase.

The sealing portion is formed by sealingly bonding the panel and the funnel by means of a sealing material as described above. A baked product of a sealing material such as a solder glass has a strength of from 60 to 70% as compared with the panel, and the strength at the sealing portion is weakest in the glass bulb due to such strength of the sealing material. Further, no compressive stress is produced to the sealing portion by an ion-exchange method.

Consequently, if a tensile vacuum stress is generated in the glass bulb employing a thin panel having a compressive stress layer formed thereon by an ion-exchange method, although the tensile vacuum stress is allowable for the face portion of the panel, it may reach the upper limit of the allowance at the sealing portion, and accordingly a face portion can not be made thin as far as possible, thus inhibiting weight reduction.

SUMMARY OF THE INVENTION

The present invention has been made in view of the above problems, and it is an object of the present invention to provide a glass bulb for a cathode ray tube wherein weight reduction and/or flattening of the face portion can be achieved by producing a high compressive stress by an ion-exchange method without decreasing the strength at the sealing portion, and to provide a cathode ray tube employing said glass bulb for a cathode ray tube, having a high safety.

To accomplish the above object, the present invention provides a glass bulb for a color cathode ray tube, which comprises a panel, a funnel connected to the panel and a neck, the panel comprising an approximately rectangular face portion and a skirt portion constituting a side wall of the face portion and having a seal edge portion at the end portion, wherein such a compressive stress $\sigma_c$ that 50 MPa$\leqq|\sigma_c|\leqq$250 MPa is produced by an ion-exchange method to at least one of short axis end portions and long axis end portions on the outer surface of the face portion; the average thickness $t=(t_c+t_{max})/2$ of the face portion represented by the central thickness $t_c$ of the face portion and the maximum thickness $t_{max}$ of the face portion, and the thickness $t_{se}$ at the seal edge portion, satisfy the relation $t/t_{se}\leqq 1.4$; and the maximum value $\sigma_{VTmax}$ of the tensile stress generated at the face portion when vacuumized is 20 MPa$\leqq\sigma_{VTmax}<$200 MPa. The present invention further provides a color cathode ray tube employing the above glass bulb.

In the glass bulb for a color cathode ray tube, the compressive stress $\sigma_c$ is more preferably 50 MPa$\leqq|\sigma_c|=\leqq$200 MPa. It is more preferred that the compressive stress is 80 MPa$\leqq|\sigma_c|\leqq$150 MPa and the maximum value $\sigma_{VTmax}$ of the tensile stress is 20 MPa$\leqq\sigma_{VTmax}\leqq$100 MPa, whereby a high industrial productivity can be obtained. Further, in the glass bulb for a color cathode ray tube of the present invention, the proportion of the average thickness t of the face portion to the thickness $t_{se}$ at the seal edge portion, i.e. $t/t_{se}$ is preferably $0.5\leqq t/t_{se}\leqq 1.0$, whereby further weight reduction becomes possible without generation of a high tensile vacuum stress at the sealing portion.

DETAILED DESCRIPTION OF THE INVENTION

Figure 1:
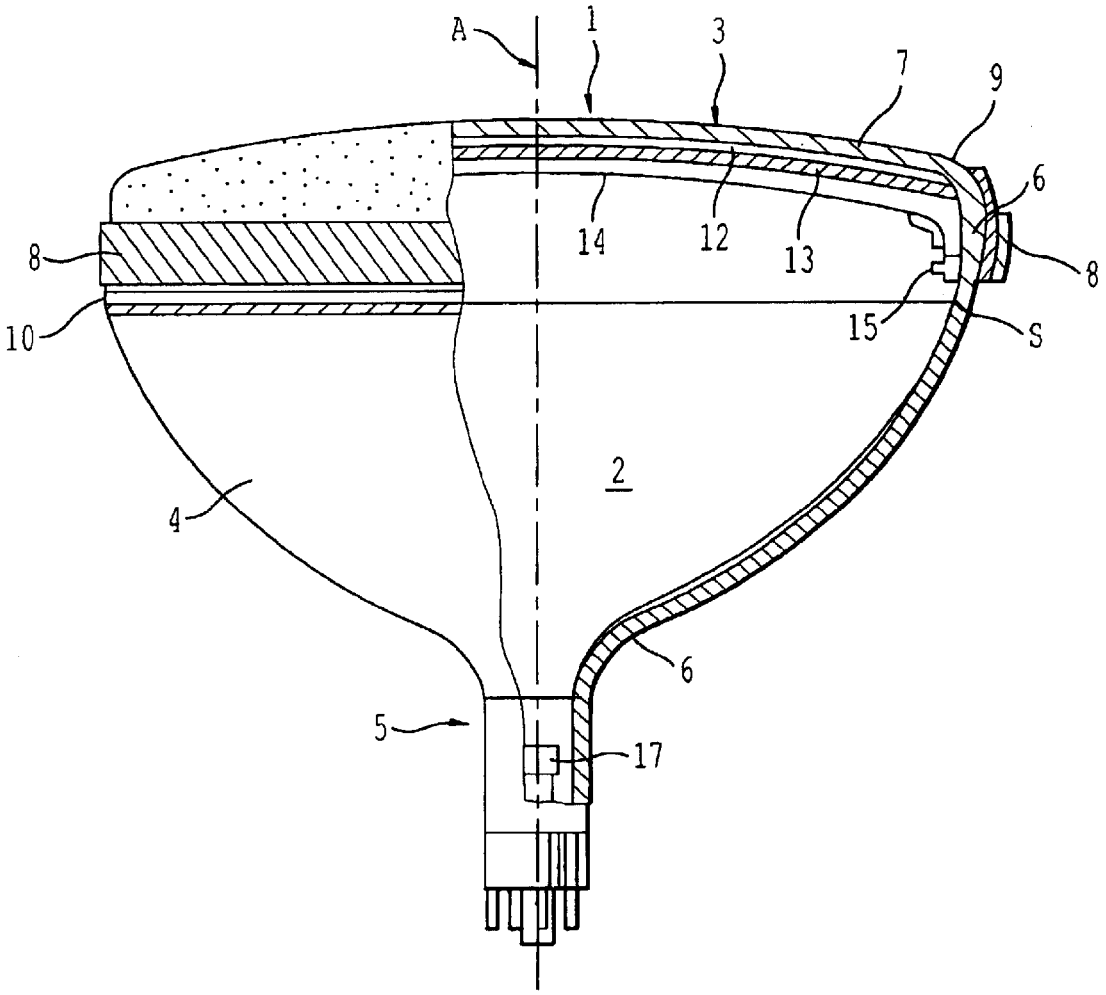
FIG. 1 is a diagram illustrating the construction of a cathode ray tube.
Figure 2:
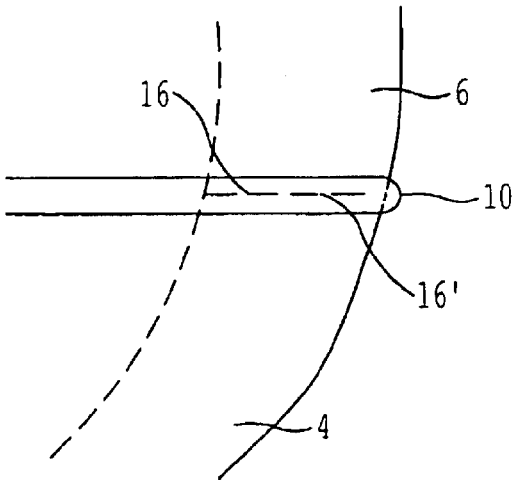
FIG. 2 is an enlarged view illustrating the sealing portion and its vicinity.

In the drawings, reference numeral 1 indicates a cathode ray tube, numeral 2 a glass bulb, numeral 3 a panel, numeral 4 a funnel, numeral 5 a neck, numeral 6 a skirt portion, numeral 7 a face portion, numeral 10 a sealing portion, numeral 21 center of the face portion, numeral 23 a short axis of the face portion, numeral 25 a long axis of the face portion, numeral 27 a short axis end portion, and numeral 28 a long axis end portion.

Now, the present invention will be described in detail with reference to Figs. Here, the glass bulb for a color cathode ray tube will be referred to as a bulb, and the glass panel will be referred to as a panel.

In the present invention, the outer surface of the panel is the surface on the outside when a bulb is formed, and the inner surface is the surface which is located on the rear side of the outer surface, i.e. on the side to be coated with a phosphor, and which constitutes an inner side when a bulb is formed.

Figure 3:
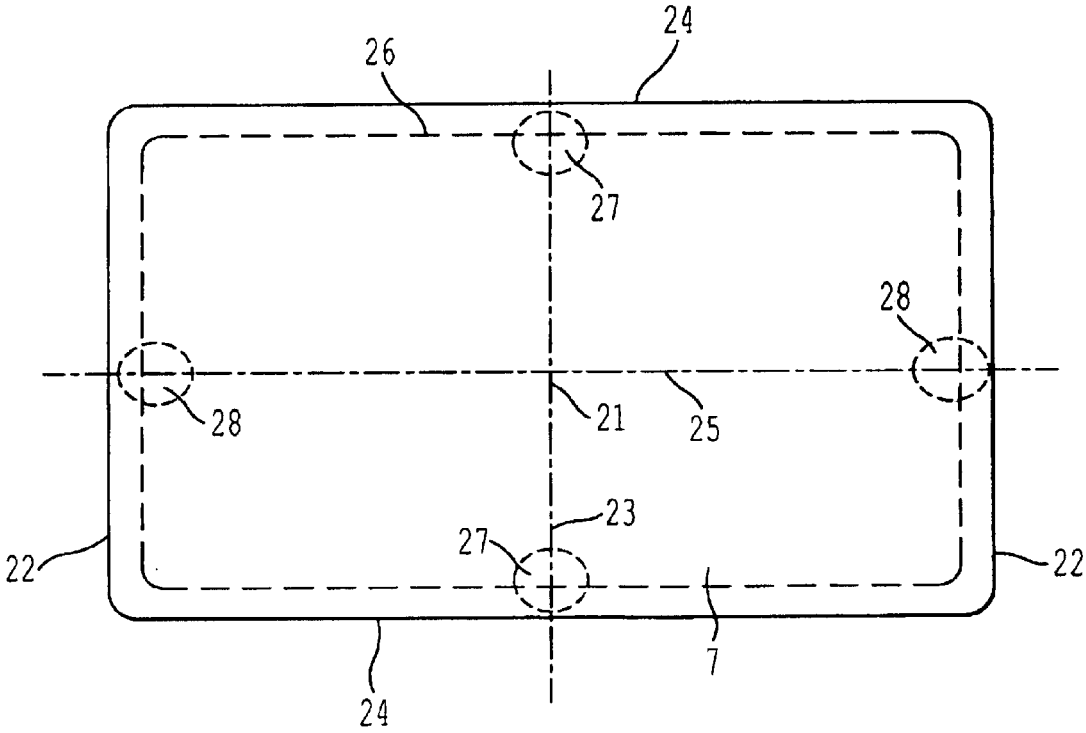
FIG. 3 is a plan view illustrating the face portion.
Figure 4:
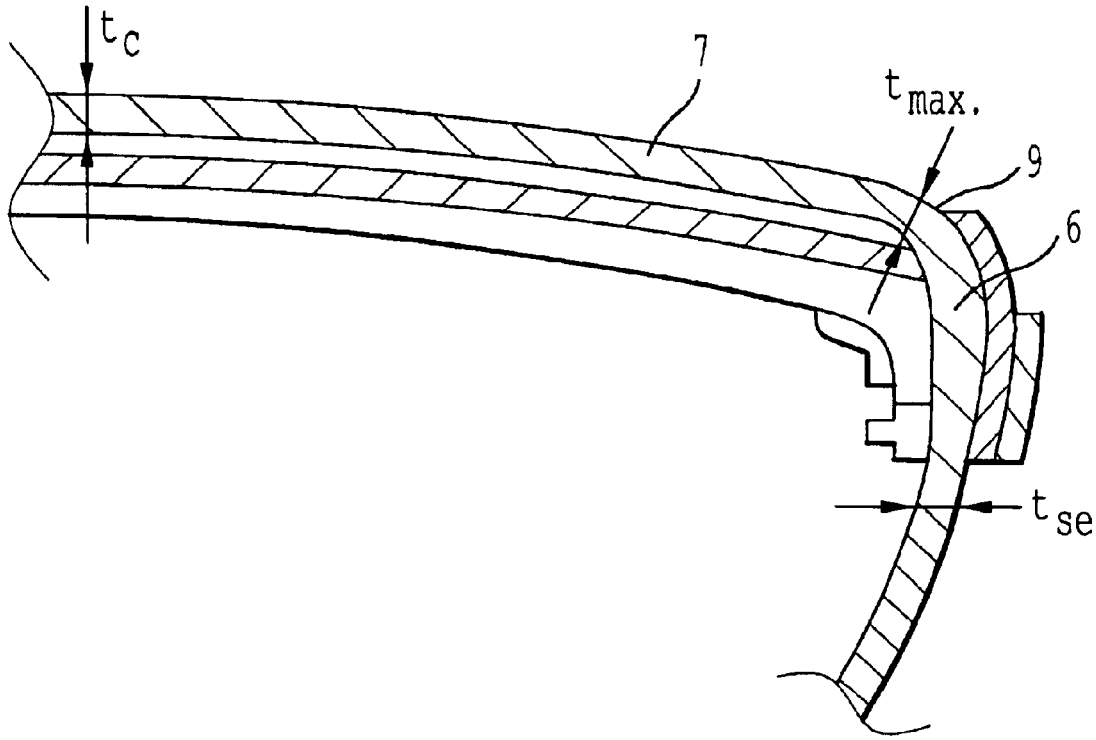
FIG. 4 is a diagram illustrating the thickness of several features of an exemplary embodiment.

As illustrated in FIG. 3 which is a plan view of the face portion, among axes passing through the center 21 of the face portion 7, the axis parallel to short sides 22 of the face portion is a short axis 23 of the face portion, and the axis parallel to long sides 24 of the face portion is a long axis 25 of the face portion. The panel of the present invention is characterized in that it has a layer having such a compressive stress $\sigma_c$ that 50 MPa$\leqq|\sigma_c|\leqq$250 MPa formed by an ion-exchange method on at least ends 27 of the short axis 23 (hereinafter referred to as short axis end portions) or ends 28 of the long axis 25 (hereinafter referred to as long axis end portions) on the outer surface of the face portion. Here, the short axis end portions 27 are meant for positions where the short axis 23 intersects the effective screen edge (picture image edge) 26 and its vicinity, and a long axis end portions 28 are meant for positions where the long axis 25 intersects the effective screen edge (picture image edge) 26 and its vicinity.

A physical tempering method has been widely carried out as a method of tempering a glass, however, as described above, a compressive stress $|\sigma_c|$ which can be produced to a panel or a funnel having a three dimensional structure and a non-uniform thickness distribution by a physical tempering method is at a level of 30 MPa at best, and no high compressive stress can be produced. Namely, in a case where a physical tempering method is employed, the compressive stress to be produced is relatively small, whereby the degree of weight reduction of the glass bulb is limited. However, in a case where an ion-exchange method is employed, a compressive stress $|\sigma_c|$ of up to 300 MPa can be produced, such being suitable for weight reduction of the bulb.

Here, in order to obtain a high safety panel, the compressive stress $|\sigma_c|$ is required to be at least 50 MPa at at least one of the short axis end portions and the long axis end portions of the outer surface of the face portion. If the compressive stress $|\sigma_c|$ exceeds 250 MPa, the compressive stress layer may be peeled off and fragmentized when the panel is destroyed, such being problematic in view of safety and production. Accordingly, the compressive stress value is 50 MPa$\leqq|\sigma_c\leqq$250 MPa.

Here, the ion-exchange method is a method as follows.

In silicate glass, usually alkali and alkaline earth elements are irregularly contained as network modifiers in the network structure constituted by Si—O bonds. The alkali ions in the glass surface layer can be substituted by monovalent ions having larger ion radii in an outer medium, by utilizing a characteristic such that among network modifiers, monovalent cations can be moved in the interior of glass relatively freely. As a result, larger ions will get into the positions from which alkali ions detached, while pushing and constraining the surrounding network structure, thereby to form a compressive stress.

For example, a method of immersing a strontium/barium/alkali/alumina/silicate glass containing from about 5 to about 8% of $Na_2O$ and from about 5 to about 9% of $K_2O$, in a molten liquid of $KNO_3$ at about 450° C. (referred to as "dipping type ion-exchange method" in the present invention) may be known. The ion-exchange method of the present invention is not limited to the above dipping type ion-exchange method.

The present inventors have further found that transfer of deformation from the face portion to the sealing portion can be inhibited by further decreasing the difference in rigidity between the face portion and the skirt portion (provided that (rigidity of the face portion)<(rigidity of the skirt portion)) as compared with a conventional one. When the difference in rigidity between the face portion and the skirt portion becomes large, the stress to be generated at the face portion may increase, but a high compressive stress can be produced to the face portion by the above ion-exchange method, whereby the face portion will not be destroyed. On the other hand, the skirt portion has a relatively high rigidity as compared with the face portion, whereby generation of the stress at the sealing portion can be inhibited.

Specifically, by reducing the proportion of the thickness of the face portion to the thickness at the seal edge portion, the difference in rigidity between the face portion and the skirt portion can be increased. Here, taking the difference in thickness between the center portion and non-center portion of the face portion into consideration, the "proportion of the average thickness of the face portion to the thickness at the seal edge portion" is represented by $t/t_{se}$ where the average thickness of the face portion is $t=(t_c+t_{max})/2$ when the central thickness of the face portion is $t_c$ and the maximum thickness of the face portion is $t_{max}$, and the thickness at the seal edge portion is $t_{se}$.

The present invention is characterized in that the value of $t/t_{se}$ is small as compared with a conventional one, specifically, the above value is at most 1.4. If the value of $t/t_{se}$ exceeds 1.4, not only the face portion becomes thick and the panel tends to be heavy, but also the tensile vacuum stress generated at the sealing portion reaches the upper limit of the allowance even though the tensile vacuum stress generated at the face portion does not reach the upper limit of the allowance. Whereas, when the value of $t/t_{se}$ is at most 1.4, the above problems can be overcome, and the face portion can be made thin as far as possible to achieve weight reduction of the panel. When the value of $t/t_{se}$ is $0.5\leqq t/t_{se}=\leqq 1.0$, a force generated at the time of deformation of the face portion may not transfer to the skirt portion, whereby it becomes possible to make the face portion thin without generating a high tensile vacuum stress at the sealing portion, and further weight reduction becomes possible, such being favorable.

Further, the bulb of the present invention is characterized in that the maximum value $\sigma_{VTmax}$ of the tensile stress generated at the face portion of the panel when the bulb is vacuumized, i.e. the tensile vacuum stress generated at the face portion, is 20 MPa$\leqq\sigma_{VTmax}\leqq$200 MPa. Here, in the present invention, the vacuum is meant for a high vacuum state.

In the above bulb, if $\sigma_{VTmax}$ is at least 200 MPa, the bulb may undergo delayed fracture, and accordingly it is preferably less than 200 MPa, and if it is less than 20 MPa in view of safety, the face portion can not be made thin and weight reduction may not be achieved, and accordingly $\sigma_{VTmax}$ is at least 20 MPa and less than 200 MPa. $\sigma_{VTmax}$ is more preferably 20 MPa$\leqq\sigma_{VTmax}\leqq$100 MPa in view of industrial productivity.

By employing a bulb having such a construction, a lightweight cathode ray tube having a high safety such as reliability in strength can be produced.

Now, the present invention will be described in further detail with reference to Examples. However, it should be understood that the present invention is by no means restricted to such specific Examples.

EXAMPLES 1 TO 4 AND COMPARATIVE EXAMPLES 1 TO 3

Seven types of panels having an aspect ratio of 16:9, a face portion effective screen diagonal conjugate diameter of 860.0 mm, a face portion maximum diagonal conjugate diameter of 912.0 mm, a face portion outer surface curvature radius of 17,000.0 mm, a face portion inner surface curvature radius of 9,400.0 mm and a skirt portion height of 120.0 mm, and different thickness of the face portion and thickness at the seal edge portion, were produced as Examples 1 to 4 and Comparative Examples 1 to 3 respectively. As the glass materials, products manufactured by Asahi Glass Company, Limited, as identified in Table 1, were employed. Here, the thickness of the face portion and the thickness at the seal edge portion in Examples and Comparative Examples were designed so that the allowable stress value at the sealing portion would be 8.5 MPa.

TABLE 1

| | Panel glass | Funnel glass | Neck glass |
|---|---|---|---|
| Tradename | 5008 | 0138 | 0150 |
| Density (g/cm$^3$) | 2.79 | 3.00 | 3.29 |
| Young's modulus | | | |

TABLE 1-continued

| | Panel glass | Funnel glass | Neck glass |
|---|---|---|---|
| (GPa) | 75 | 69 | 62 |
| Poisson ratio | 0.21 | 0.21 | 0.23 |
| Softening point (° C.) | 703 | 663 | 643 |
| Quenching point (° C.) | 521 | 491 | 466 |
| Distortion point (° C.) | 477 | 453 | 428 |

Then, each of the panels of Examples 1 to 4 and Comparative Examples 1 and 2 were immersed in a molten liquid of $KNO_3$ and heated at 450° C. for 6 hours to conduct an ion-exchange treatment by means of the above-described dipping type ion-exchange method to form a compressive stress layer on the surface. Further, the panel of Example 3 was immersed in a molten liquid of $KNO_3$ and heated at 440° C. for 12 hours, and the panel of Example 4 was immersed in a molten liquid of $KNO_3$ and heated at 440° C. for 24 hours, to conduct an ion-exchange treatment by means of the dipping type ion-exchange method to form a compressive stress layer on the surface. With respect to the panel of Comparative Example 3, a cooling air was blown thereto after molding to generate distortion, then the panel was quenched in a quenching furnace by adjusting the temperature so that the distortion would not completely be removed, and a compressive stress layer was formed. The values of the compressive stress $|\sigma_c|$ produced to the short axis end portions in Examples and Comparative Examples are shown in Table 2.

The mass of each panel was measured, and then the panel and a funnel were sealingly bonded by means of a sealing material (tradename: ASF-1307R) manufactured by Asahi Glass Company, Limited, by baking at about 440° C. for 35 minutes, and the funnel and a neck were connected to each other to form a bulb. Then, the bulb was vacuumized, and the maximum value $\sigma_{VTmax}$ of the tensile vacuum stress generated at the short axis end portions of the face portion was measured when the tensile vacuum stress generated at the sealing portion was the allowable stress value at the sealing portion (8.5 MPa).

Now, in Table 2, the central thickness of the face portion: $t_c$ (mm), the maximum thickness of the face portion: $t_{max}$ (mm), the average thickness of the face portion: t(mm)=($t_c$+$t_{max}$)/2, the thickness at the seal edge portion: $t_{se}$ (mm), $t/t_{se}$, the compressive stress produced to the short axis end portions of the outer surface of the panel: $|\sigma_c|$ (MPa), the allowable stress value at the face portion: $\sigma_{Af}$ (MPa), the allowable stress value at the sealing portion: $\sigma_{As}$ (MPa), the mass of the panel: $m_p$ (kg), the tensile vacuum stress generated at the sealing portion: $\sigma_{VTs}$ (MPa), and the maximum value of the tensile vacuum stress generated at the face portion: $\sigma_{VTmax}$ (MPa), are shown.

Here, in Examples and Comparative Examples, the compressive stress value $\sigma_c$ was measured as follows.

As one method of measuring the stress of glass, a measuring method utilizing such a characteristic that the difference in refractive index in a principal stress direction generated when a force is applied to glass, is proportional to the stress difference, may be mentioned. When linear polarization is transmitted through the glass to which a stress is applied, the transmitted light has a plane of polarization perpendicular to the principal stress direction and is decomposed into component waves having different velocities. One component wave is behind the other after transmitted through the glass, and the refractive index of the glass is different in the principal stress direction depending upon the velocity of each component wave. The stress difference of the glass is proportional to the difference in refractive index i.e. so-called birefringence, and accordingly the stress can be measured from the phase difference of the component waves.

By means of a polarizing microscope utilizing the above principle, light is transmitted through a glass section having a residual stress, and the phase difference of components vibrating in the principal stress direction after transmission is measured to obtain the stress. At that time, a polarizer is disposed in front of the glass through which light is to be transmitted, and a plate having a phase difference and an analyzer to detect polarization are disposed at the back of the glass through which light is transmitted. Examples of the plate having a phase difference include a Breck compensator, a Babinet compensator and a ¼ wavelength plate. By utilizing such a plate, a dark line can be formed so that the phase difference is zero at a region to be measured, whereby the value of the stress can be obtained from the adjustment amount of the compensator.

Further, by utilizing a sensitive color plate having an optical path difference of approximately 565 nm, wherein interference colors change with a slight change in optical path difference, instead of the above compensator, interference colors depending upon the phase difference due to a slight birefringence after transmission through the glass can be represented, whereby the level of the stress can be identified by the color. By utilizing such a nature, the glass section is observed and the thickness of the stress layer is measured. In the present invention, as a plate having a phase difference, a Breck compensator was used.

Further, $\sigma_{VTs}$ and $\sigma_{VTmax}$ were measured by attaching a strain gauge KFG-5-120-D16-11 manufactured by Kyowa Electronic Instruments, Co., Ltd to a predetermined position.

TABLE 2

| | Ex. 1 | Ex. 2 | Comp. Ex. 1 | Comp. Ex. 2 | Comp. Ex. 3 | Ex. 3 | Ex. 4 |
|---|---|---|---|---|---|---|---|
| $t_c$ (mm) | 10.5 | 8.5 | 13.5 | 11.0 | 20.0 | 9.0 | 7.2 |
| $t_{max}$ (mm) | 14.9 | 16.0 | 17.9 | 18.5 | 24.5 | 13.5 | 11.7 |
| t (mm) | 12.7 | 12.3 | 15.7 | 14.8 | 22.3 | 11.3 | 9.5 |
| $t_{se}$ (m/m) | 10.0 | 11.0 | 9.0 | 9.5 | 12.5 | 12.5 | 12.5 |
| $t/t_{se}$ | 1.3 | 1.1 | 1.7 | 1.6 | 1.8 | 0.9 | 0.8 |
| $\lvert\sigma_c\rvert$ (MPa) | 100 | 100 | 100 | 100 | 13 | 160 | 240.0 |
| $\sigma_{Af}$ (MPa) | 50 | 50 | 50 | 50 | 11 | 80 | 160 |
| $\sigma_{As}$ (MPa) | 8.5 | 8.5 | 8.5 | 8.5 | 8.5 | 8.5 | 8.5 |
| $m_p$ (kg) | 24.2 | 24.5 | 26.8 | 26.3 | 34.8 | 23.4 | 21.4 |
| $\sigma_{VTs}$ (MPa) | 8.5 | 8.5 | 8.5 | 8.5 | 8.5 | 8.0 | 8.5 |
| $\sigma_{VTmax}$ (MPa) | 49 | 44 | 49 | 40 | 11 | 78 | 143 |

In Examples 1 to 4, Comparative Examples 1 and 2 wherein a compressive stress layer was formed by an ion-exchange method, a high outer surface compressive stress could be produced, and the mass could be reduced by at least 20%, as compared with Comparative Example 3 wherein a compressive stress layer was formed by a physical tempering method. Particularly, Examples 1 and 2 wherein the value of $t/t_{se}$ was at most 1.4, the thickness of the face portion could be made thin as compared with Comparative Examples 1 and 2 wherein $t/t_{se}>1.4$, whereby weight reduction by about 30% became possible as compared with Comparative Example 3. Further, in Example 3 wherein $t/t_{se}$ was 0.9 and the compressive stress value $|\sigma_c|$ was 160 MPa, weight reduction by about 33% was achieved, and in Example 4 wherein $t/t_{se}$ was 0.8 and the compressive stress value $|\sigma_c|$ was 240 MPa, weight reduction by about 39% was achieved.

According to the present invention, while securing the strength at the sealing portion by setting the ratio of the thickness of the face portion to the thickness at the seal edge portion of the panel within a suitable range, a compressive stress which counterbalances the maximum value of the tensile vacuum stress generated at the face portion, is produced by an ion-exchange method to at least short axis end portions or long axis end portions on the outer surface of the face portion of the panel, whereby the face portion can be made thin as far as possible, and consequently, a lightweight bulb can be provided. Further, by employing such a bulb, a lightweight and safe cathode ray tube can be provided.

The entire disclosure of Japanese Patent Application No. 2001-164084 filed on May 31, 2001 including specification, claims, drawings and summary are incorporated herein by reference in its entirety.

What is claimed is:

1. A glass bulb for a color cathode ray tube, which comprises: a panel having a face portion and a skirt portion constituting a side wall of the face portion and having a seal edge portion, a compressive stress $\sigma_c$ of 50 MPa$\leqq|\sigma_c|\leqq$250 MPa in at least one of short axis end portions and long axis end portions on the outer surface of the face portion; the average thickness $t=(t_c+t_{max})/2$ of the face portion represented by the central thickness $t_c$ of the face portion and the maximum thickness $t_{max}$ of the face portion, and the thickness $t_{se}$ at the seal edge portion, satisfy the relation $t/t_{se}\leqq 1.4$; and the maximum value $\sigma_{VTmax}$ of the tensile stress generated at the face portion when vacuumized is 20 MPa$\leqq\sigma_{VTmax}<$200 MPa;

a funnel connected to the panel along the seal edge; and a neck extending from the funnel.

2. The glass bulb for a color cathode ray tube according to claim 1, wherein the compressive stress $\sigma_c$ is 50 MPa$\leqq|\sigma_c|\leqq$200 MPa.

3. The glass bulb for a color cathode ray tube according to claim 2, wherein the compressive stress $\sigma_c$ is 80 MPa$\leqq|\sigma_c|\leqq$150 MPa, and the maximum value $\sigma_{VTmax}$ of the tensile stress is 20 MPa$\leqq\sigma_{VTmax}$100 MPa.

4. The glass bulb for a color cathode ray tube according to claim 1, wherein the proportion $t/t_{se}$ of the average thickness t of the face portion to the thickness $t_{se}$ at the seal edge portion is $0.5\leqq t/t_{se}\leqq 1.0$.

5. A color cathode ray tube, employing the glass bulb for a color cathode ray tube as defined in claim 1.

* * * * *